US008342264B1

(12) United States Patent
Hinshaw et al.

(10) Patent No.: US 8,342,264 B1
(45) Date of Patent: Jan. 1, 2013

(54) DEVICE FOR REDUCING DRILLING NOISE AND RELATED METHODS

(75) Inventors: Gregory E. Hinshaw, Proctorville, OH (US); Henry E. Wilson, Ironton, OH (US); Sean Joseph McQuerrey, South Charleston, WV (US)

(73) Assignee: J.H. Fletcher & Co., Huntington, WV (US)

( * ) Notice: Subject to any disclaimer, the term of this patent is extended or adjusted under 35 U.S.C. 154(b) by 408 days.

(21) Appl. No.: 12/719,304

(22) Filed: Mar. 8, 2010

Related U.S. Application Data

(60) Provisional application No. 61/158,501, filed on Mar. 9, 2009.

(51) Int. Cl.
*E21B 15/00* (2006.01)
*E21B 1/00* (2006.01)

(52) U.S. Cl. ..... 175/57; 173/DIG. 2

(58) Field of Classification Search ..... 175/162, 175/57; 166/75.11; 173/DIG. 2; 181/230, 181/241, 255, 269, 198
See application file for complete search history.

(56) References Cited

U.S. PATENT DOCUMENTS

| | | | | |
|---|---|---|---|---|
| 2,107,552 | A * | 2/1938 | Smith | 175/209 |
| 2,122,517 | A | 7/1938 | John | |
| 2,702,181 | A * | 2/1955 | Brown et al. | 175/209 |
| 3,536,149 | A | 10/1970 | Laird | |
| 3,583,821 | A | 6/1971 | Shaub et al. | |
| 3,638,737 | A | 2/1972 | Moates | |
| 3,667,571 | A * | 6/1972 | Fattelay | 181/230 |
| 3,757,891 | A | 9/1973 | Krieger | |
| 3,975,918 | A | 8/1976 | Jansz | |
| 4,113,049 | A | 9/1978 | Lieber | |
| 4,319,647 | A | 3/1982 | Browning | |
| 4,591,009 | A | 5/1986 | Marcel et al. | |
| 4,921,375 | A * | 5/1990 | Famulari | 408/67 |
| 4,955,984 | A * | 9/1990 | Cuevas | 408/67 |
| 5,137,096 | A | 8/1992 | Druesdow | |
| 5,419,663 | A | 5/1995 | Psomas | |
| 5,615,981 | A * | 4/1997 | Wheatley | 408/1 R |
| 5,653,561 | A | 8/1997 | May | |
| 5,688,082 | A | 11/1997 | Richardson | |

(Continued)

FOREIGN PATENT DOCUMENTS

| | | |
|---|---|---|
| DE | 2824672 | 12/1979 |
| DE | 2930296 | 2/1981 |
| DE | 3120615 | 12/1982 |
| DE | 102004008101 | 9/2005 |

(Continued)

OTHER PUBLICATIONS

"Collapsible Drill Steel Enclosure for Reducing Roof Bolting Machine Drilling Noise" Milestones in Mining Safety and Health Technology No. 523, Sep. 2008, DHHS (NIOSH) Publication No. 2008-146 2 Pages.

*Primary Examiner* — Daniel P Stephenson
(74) *Attorney, Agent, or Firm* — King & Schickli, PLLC

(57) ABSTRACT

An apparatus abates noise from the operation of a drill head including a drilling element for engaging a face of a mine passage during a drilling cycle in which the drill head moves from a first position farther from the face to a second position closer to the face. The apparatus includes a collapsible barrier capable of moving between an extended condition to cover a portion of the drilling element during the formation of the borehole and a retracted condition in which the portion of the drilling element covered in the extended condition is exposed. A holder is adapted for releasably coupling with the barrier in the extended condition. Related methods are also disclosed.

20 Claims, 8 Drawing Sheets

U.S. PATENT DOCUMENTS

| | | | | |
|---|---|---|---|---|
| 5,765,654 | A * | 6/1998 | Burger | 175/211 |
| 5,993,305 | A | 11/1999 | Chu | |
| 6,199,656 | B1 | 3/2001 | Vento et al. | |
| 6,427,782 | B2 | 8/2002 | Brady | |
| 7,011,167 | B2 * | 3/2006 | Ebner et al. | 175/209 |
| 7,730,973 | B2 * | 6/2010 | Haglund | 175/162 |
| 8,137,165 | B2 * | 3/2012 | Loveless et al. | 451/456 |
| 2003/0111266 | A1 * | 6/2003 | Roach | 175/57 |
| 2007/0243031 | A1 | 10/2007 | Yun | |
| 2008/0142270 | A1 | 6/2008 | Haglund | |
| 2012/0024607 | A1 * | 2/2012 | Swope et al. | 175/209 |

FOREIGN PATENT DOCUMENTS

| | | |
|---|---|---|
| EP | 0066891 | 12/1982 |
| GB | 1097169 | 12/1967 |
| JP | 60159218 | 8/1985 |
| JP | 6185055 | 7/1994 |
| JP | 2005305616 | 11/2005 |
| JP | 2006022568 | 1/2006 |
| JP | 2008308970 | 12/2008 |
| WO | 02070856 | 9/2002 |
| WO | 2008122696 | 10/2008 |

* cited by examiner

DEVICE FOR REDUCING DRILLING NOISE AND RELATED METHODS

This application claims the benefit of U.S. Provisional Patent Application Ser. No. 61/158,501 filed on Mar. 9, 2009, the disclosure of which is incorporated herein by reference.

TECHNICAL FIELD

The present invention relates to the drilling arts and, more particularly, to a device and related methods for reducing noise during drilling.

BACKGROUND OF THE INVENTION

The operation of a drill to form a borehole can be noisy, especially in a confined area such as an underground mine. A substantial part of the noise generated during drilling arises from the relatively rapid rotation of the drilling element used to form the borehole. It would thus be advantageous to abate this noise in a simple and cost-effective manner, and with minimal increase in effort by the operator of the drill.

SUMMARY OF THE INVENTION

An apparatus is provided for use in abating noise arising from the operation of a drill head including a drilling element for engaging a face of a mine passage during a drilling cycle in which the drill head moves from a first position farther from the face to a second position closer to the face. The apparatus comprises a collapsible barrier capable of moving between an extended condition covering a portion of the drilling element and a retracted condition in which the portion of the drilling element covered in the extended condition is exposed. The apparatus further includes a holder adapted for releasably coupling with and holding the barrier in the extended condition.

In a particularly preferred embodiment, the holder comprises at least one first magnet for forming a magnetic coupling with a coupler associated with an upper end of the barrier. Preferably, the holder further comprises a plurality of magnets. The coupler may comprise projections for coupling with the magnets of the holder.

A projection may be provided for breaking this magnetic coupling at the end of the advance of the drill head so that the barrier in the retracted condition may travel with the drill head in moving from the second position to the first position. Preferably, the at least one magnet is carried by a movable arm, and the projection moves the arm to break the coupling. The projection may be carried by the drill head, which may be supported by a mast that also supports the holder.

A cover may be provided for at least partially covering an upper end of the collapsible barrier. The cover includes an opening for receiving the drilling element. A lower end of the barrier is adapted for being removably connected to the drill head by at least one fastener.

Another aspect of the disclosure relates to an apparatus for use abating noise from the operation of a drill head including a drilling element for engaging a face of a mine passage during a drilling cycle in which the drill head moves from a first position farther from the face to a second position closer to the face. The apparatus comprises a collapsible barrier for at least partially covering the drilling element. The collapsible barrier is capable of assuming a retracted condition and an extended condition. A holder is also provided for holding the barrier in the extended condition, and the collapsible barrier separates from the holder in the retracted condition.

In one embodiment, the apparatus includes a coupler carried by the collapsible barrier for releasably coupling with the holder in the extended condition. Preferably, the holder comprises a first magnet for forming a magnetic coupling with the coupler. A projection may be positioned adjacent the path of travel of the barrier for breaking the coupling at the end of the advance of the drill head so that the barrier in the retracted condition may travel with the drill head to a home position. Preferably, the projection is carried by the drill head.

A further aspect of the disclosure relates to a method of abating noise from the operation of a drill head including a drilling element for engaging a face of a mine passage during a drilling cycle in which the drill head moves from a first position farther from the face to a second, advanced position closer to the face. The method comprises: (1) covering a portion of the drilling element with a collapsible barrier maintained in an extended condition by a releasable coupling with a holder; (2) using the drilling element to at least partially form a borehole in the face of the mine passage; and (3) retracting the drilling element with the barrier in the retracted condition in which the portion of the drilling element covered in the extended condition is exposed.

In one embodiment, the covering step comprises coupling the collapsible barrier to the drill head at one end and to the holder at the opposite end. Preferably, the coupling step comprises magnetically coupling a coupler carried by the collapsible barrier to the holder. The method may further include the steps of: (1) breaking the magnetic coupling before the retracting step; and (2) supporting the holder from a drill mast along which the drill head travels to form the borehole. Still further, the method may involve removing the drilling element from the drill head after the retracting step and associating a roof bolt with the drill head.

Yet a further aspect of the disclosure is a method of abating noise from the operation of a drill head including a drilling element for engaging a surface of a mine passage during a drilling cycle in which the drill head moves from a home position farther from the face to an advanced position closer to the face. The method comprises covering a portion of the drilling element with a collapsible barrier in an extended condition; releasably coupling the barrier to a holder in the extended condition; advancing the drilling element to at least partially form a borehole in the face of the mine passage; retracting the drilling element; and retracting the barrier to expose the portion of the drilling element. The method may further include the steps of removing the drilling element from the drill head after the retracting step, associating a roof bolt with the drill head, and advancing the drill head to insert the roof bolt in the borehole.

DETAILED DESCRIPTION OF THE INVENTION

Figure 1:
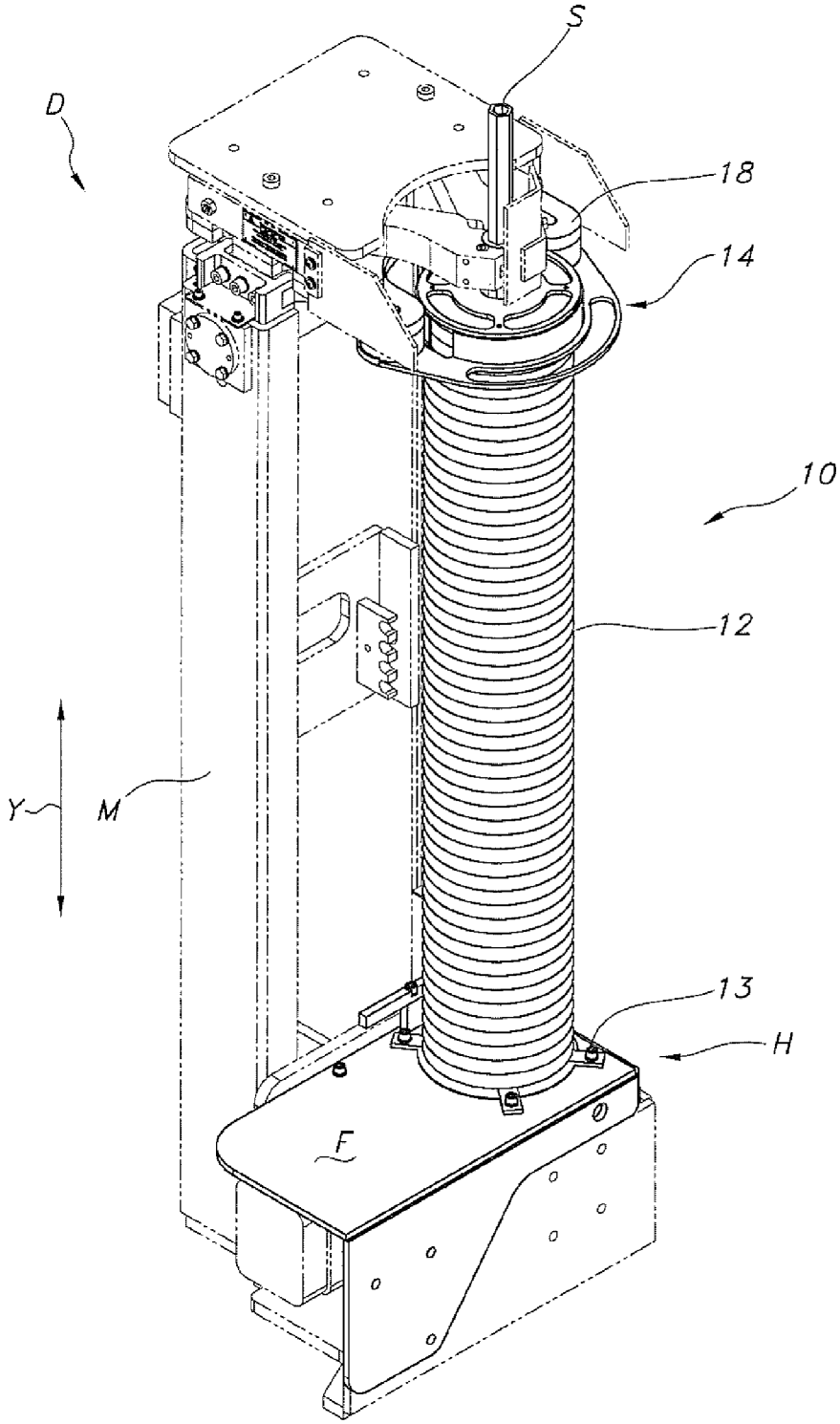
FIG. 1 is a perspective view of a drilling unit incorporating the apparatus for abating noise during a drilling operation.
Figure 2A:
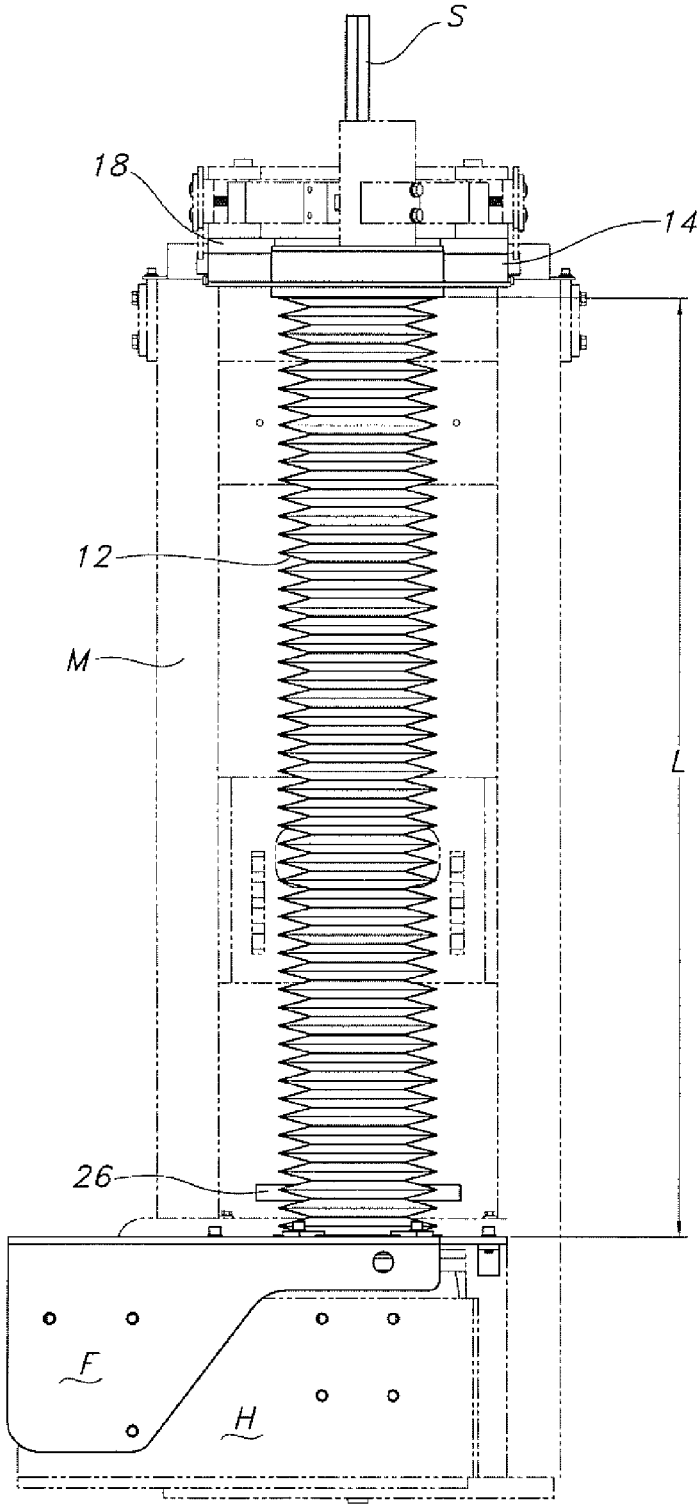
FIG. 2*a* is a side view of the drilling unit of FIG. 1.
Figure 2B:
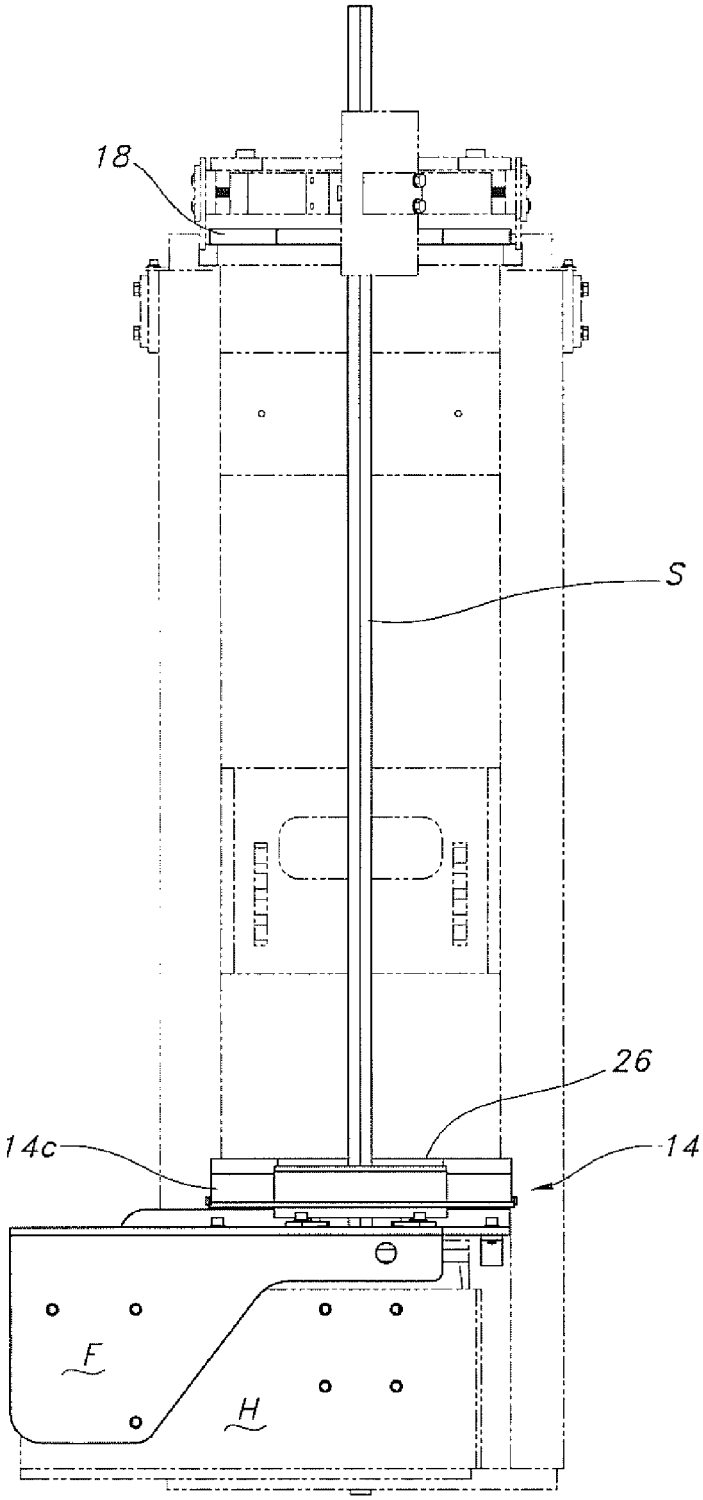
FIG. 2*b* is a side view of the drilling unit with the device in a retracted condition.
Figure 3:
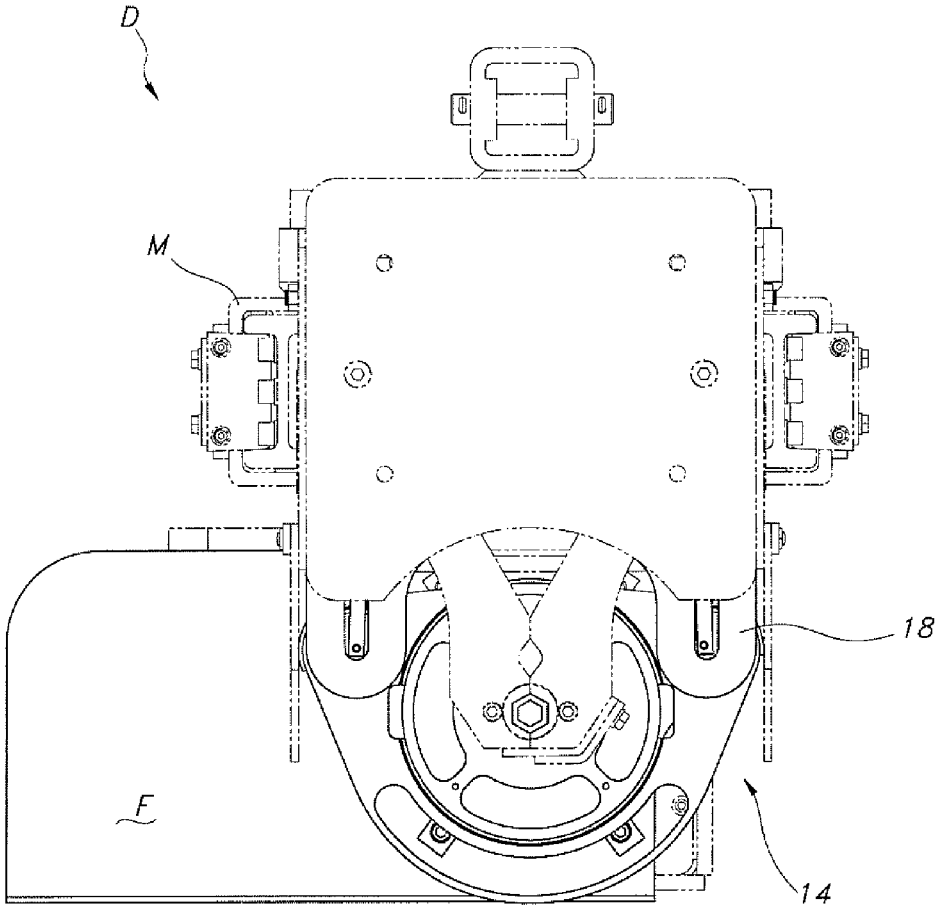
FIG. 3 is a top view of the drilling unit of FIG. 1.
Figure 4:
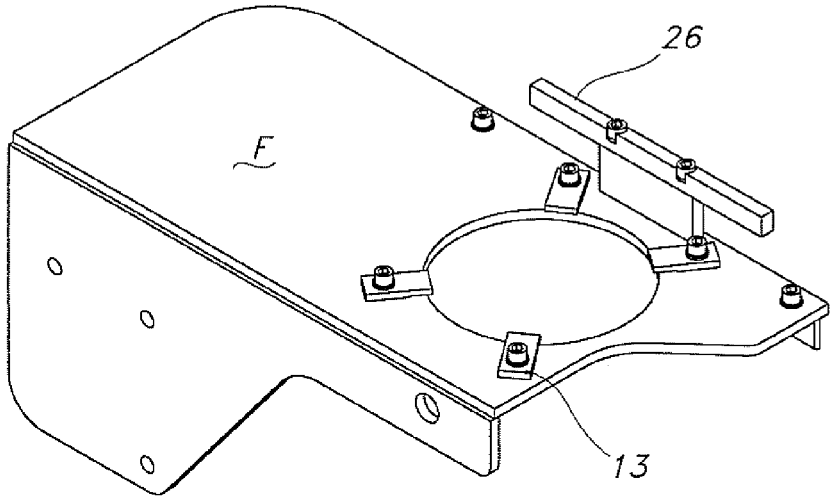
FIGS. 4, 5, and 6 are perspective views of various components forming part of the preferred embodiment of the apparatus for abating noise during a drilling operation.

Reference is now made to FIGS. 1-3, which illustrate an exemplary drilling unit D or "rig" incorporating a device 10 for assisting in reducing the noise generated by a drilling element, or drill "steel" S in the vernacular. Generally, the drilling unit D may be used to form a borehole in a face of a mine passage, such as the roof (i.e., ceiling) or rib (i.e., sidewall). However, this is merely one environment in which the device 10 of the present invention can be utilized to abate drilling noise.

In the embodiment shown, the device 10 comprises a collapsible barrier adapted for at least partially covering the drill steel S during the formation of the borehole. This device 10 is preferably arranged such that it does not interfere with the movement of an associated drill head H, which provides the motive force to the drill steel S for forming the borehole (usually rotational, but also possibly percussive as well). Preferably, the drill head H is arranged to travel linearly along a mast M (shown in phantom in FIGS. 1-3) toward and away from the adjacent face of the mine passage in a reciprocal fashion during the drilling cycle (that is, from a first or home position farther away from the face, to an advanced position during the formation of the borehole, and back again).

To achieve the desired noise abatement, the barrier in the most preferred embodiment comprises an accordion-style, generally tubular bellows 12. When fully extended, this bellows 12 is elongated in the drilling direction Y (that is, along the axis of the drill steel S) and flexible for movement at least in this direction (which corresponds to the direction of elongation of the drill steel S). Thus, it can be moved to an extended position (e.g., extended length=L in FIG. 1) to at least partially cover a major portion of the drill steel S (which has a length less than L), including during its use in forming a borehole. Yet, the bellows 12 is sufficiently flexible such that it is capable of being collapsed to a retracted position (e.g., retracted length<L), such as for accessing (e.g., inserting or removing) the drill steel prior to the initiation or after completion of the drilling cycle (in which case a roof bolt may replace the drill steel). Despite the preference for a bellows 12, it should be appreciated that the device 10 is not limited to a particular structural arrangement, and comprise any tubular, at least partially flexible structure that at least temporarily forms a barrier around at least a portion of the drill steel S to reduce noise.

In the illustrated embodiment, the lower end of the bellows 12 is supported by and attached to the drill head H, with a first, lowermost end being positioned adjacent the chuck thereof (not shown). Preferably, this is accomplished by providing one or more removable fasteners 13 on a support frame F connected to the drill head H. Most preferably, a plurality of such fasteners 13 are adapted for connecting to a ring secured to the lowermost end of the bellows 12 to provide the desired secure retention function.

Figure 5:
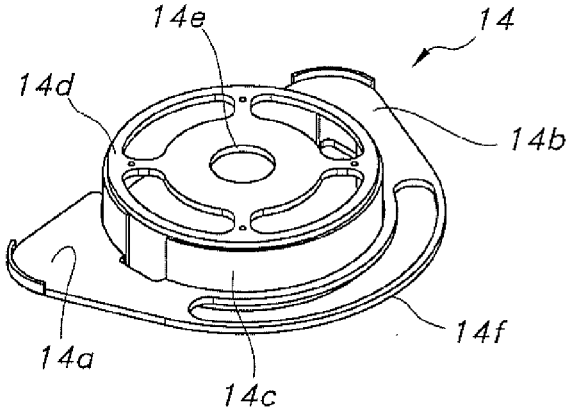

The opposite or upper end of the bellows 12 carries a coupler 14 adapted for forming a releasable coupling with a holder 18 associated with the drilling unit D in the extended condition. As perhaps best shown in FIG. 5, this coupler 14 preferably includes at least one, and more preferably a pair of spaced projections 14*a*, 14*b* in the nature of ears. Most preferably, the coupler 14 includes an upstanding sidewall 14*c* for fully covering at least the periphery of the bellows 12 in the retracted condition (see FIGS. 2*b* and 7), as well as a cover 14*d* including an opening 14*e* adapted for receiving the drill steel S (or a roof bolt, once the borehole is formed). The coupler 14 may also include a handle 14*f* to facilitate manual grasping by the operator.

Figure 6:
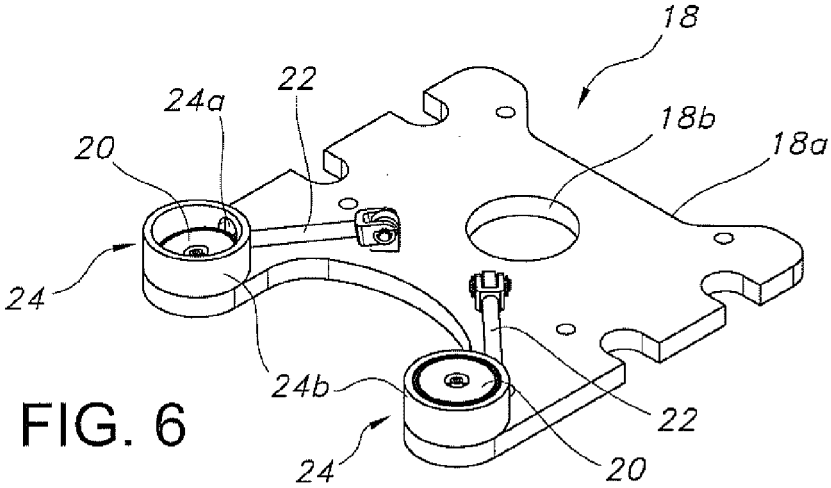
Figure 9:
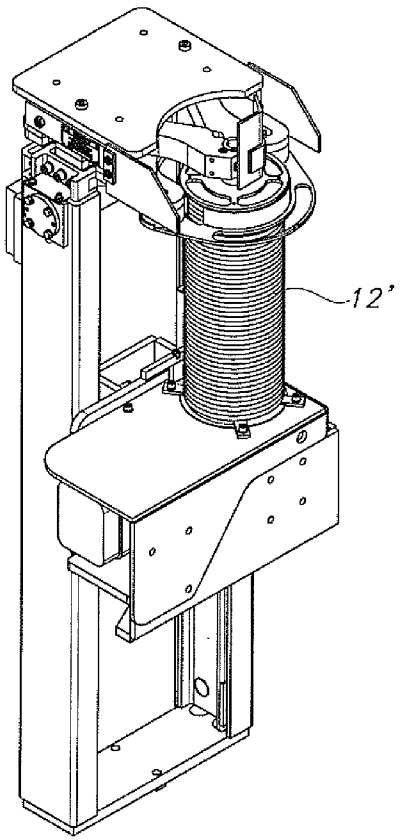
FIGS. 7, 8, and 9 are schematic perspective views showing a collapsible barrier forming part of the apparatus in retracted, extended, and partially extended conditions.

Referring to FIG. 6, a preferred embodiment of the holder 18 is shown oriented in a perspective view and upside down from the actual position in which it is used in the embodiments shown in FIGS. 1-3. The holder 18 includes a base 18*a* adapted to form the desired releasable coupling with the coupler 14 in the extended condition (and is shown as also including an opening 18*b* through which the drill steel S may pass). Preferably, this coupling is a magnetic one, formed by at least one, and preferably a plurality of magnets 20 positioned so as to engage the coupler 14 when the bellows 12 is in the extended condition. More preferably, first and second spaced magnets 20 are positioned so as to correspond to the projections 14*a*, 14*b* of the coupler 14. Most preferably, these magnets 20 are carried by pivotally mounted support arms 22, which may be carried by the holder 18.

A retainer 24 is also provided for controlling the relative movement of the arms 22 between a first, lower position for coupling the magnets 20 with the projections 14*a*, 14*b* for holding the bellows 12 in the extended condition, and a second, higher position in which the bellows 12 can assume the retracted condition and be withdrawn from adjacent the corresponding face of the mine passage. Preferably, the retainer 24 takes the form of a vertically extending slot 24*a* in an annular sidewall 24*b* through which the corresponding arm 22 passes to connect with the associated magnet 20. The slots 24*a* are sized to allow the arms 22 to assume their respective positions, with the lower end thus defining the position where the magnets 20 are sufficiently close to the projections 14*a*, 14*b* for form the desired magnetic coupling when the bellows 12 is in the extended condition.

Figure 7:
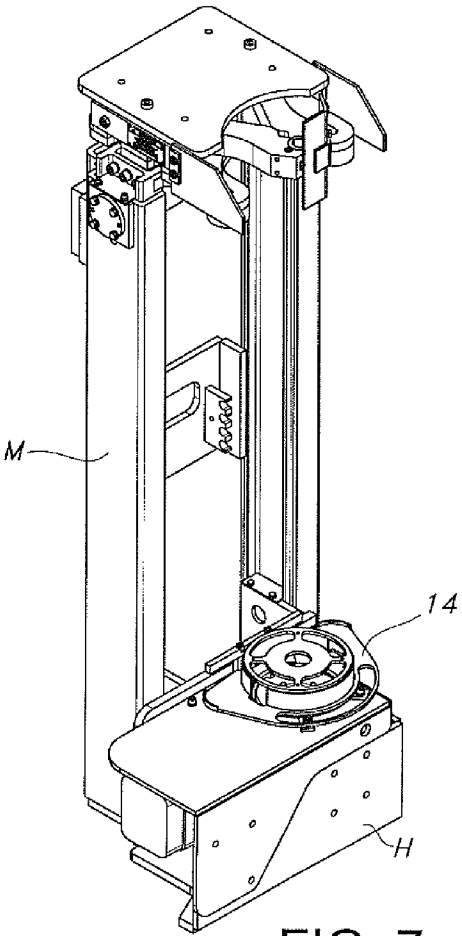
Figure 10:
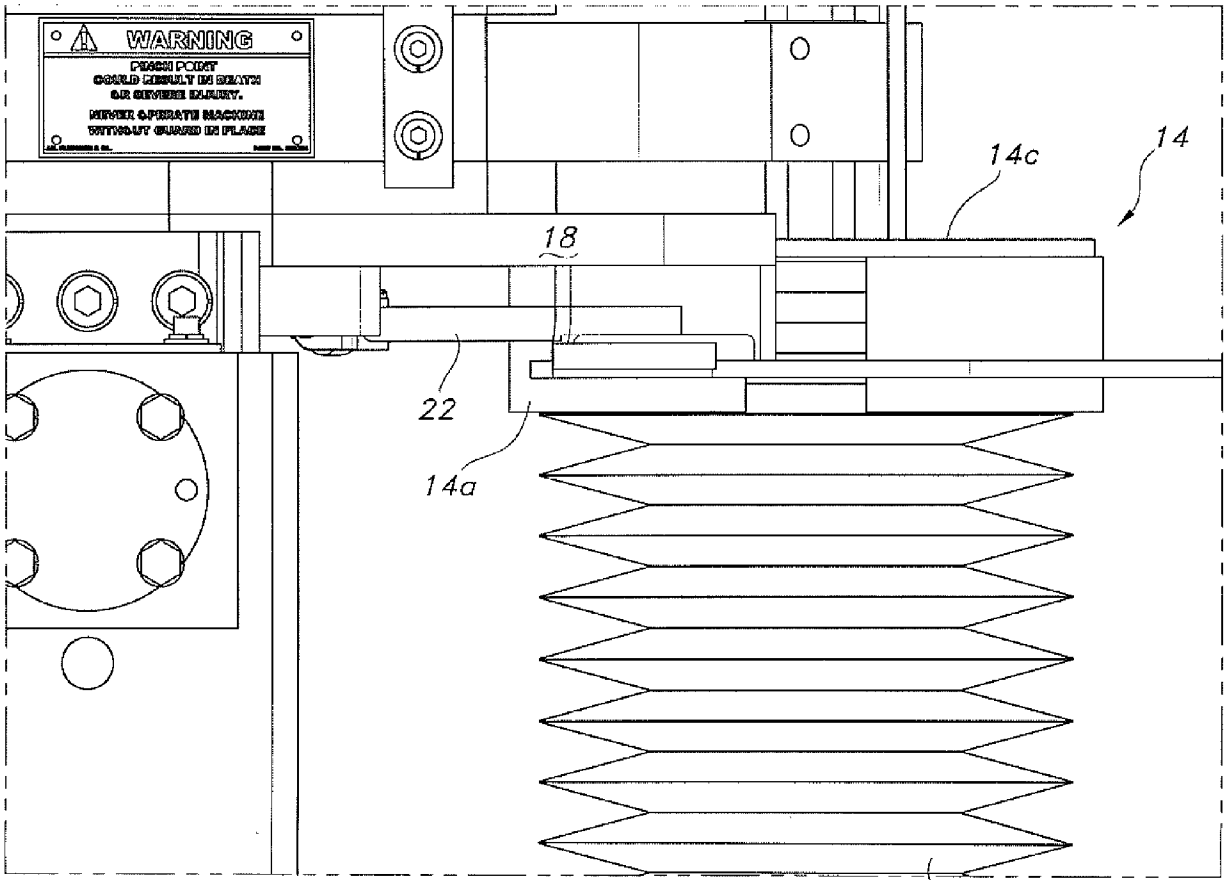
FIG. 10 is an enlarged, partially cutaway, side schematic view of the collapsible barrier held in the extended condition.

In the preferred manner of use, and with reference to FIGS. 7-11, the bellows 12 may initially be initially in a retracted condition (FIG. 7). If not already present, the operator inserts the drill steel S into the drill chuck forming part of the drill head H (see, e.g., FIG. 2*b*). Preferably, this is done by passing the lower end of the steel S through the circular opening 14*e* of the cover 14*d* attached to the coupler 14 and through the compressed or retracted bellows 12 (the periphery of which may be substantially covered by the sidewall 14*c* of coupler 14). However, it is possible, but less preferable, to first associate the drill steel S with the chuck, and then install the bellows 12 on the drill head H. The opposite end of the steel S may be supported and guided by a drill guide, which may take many forms and is considered optional.

Figure 8:
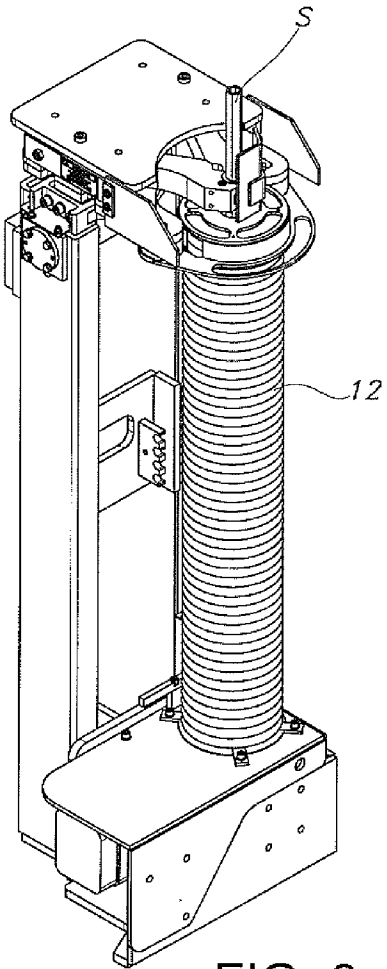

Prior to initiating the drilling, the operator positions the bellows 12 to at least partially cover the drill steel S (FIG. 8). For example, using the handle 14*f* of coupler 14, a first, upper end of bellows 12 may be extended to engage the holder 18 and such that a major portion of the drill steel S is covered. Preferably, this engagement is such that it forms the desired coupling in view of the interaction and relatively close spacing of magnets 20 (which are in the first, lower position as the result of gravity) and the projections 14*a*, 14*b* (see, e.g., FIG. 10).

As a result, the bellows 12 may be fully extended at the beginning of the drilling cycle, but a portion of the steel S remains exposed for engaging a drill guide or the like (and also allows for the operator to view the drilling operation at the face). The drilling operation may then commence, with the drill head H advancing to cause the drill steel S to form the borehole in the face of the mine passage. During this advance, it should be appreciated that the bellows 12 is allowed to collapse (note partially collapsed condition 12' in FIG. 9), and thus does not impede the drilling operation during the cycle.

Figure 11:
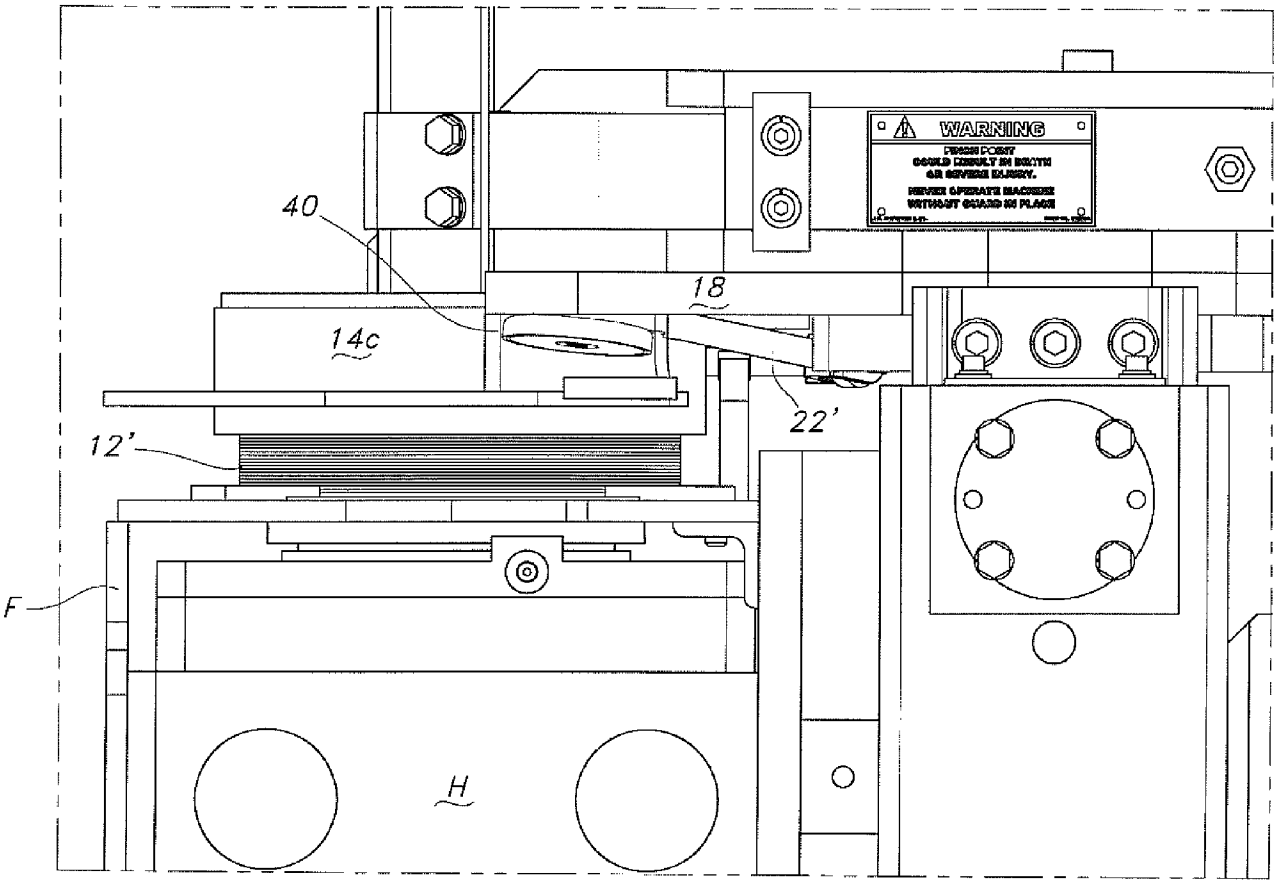
FIG. 11 is an enlarged, partially cutaway, side schematic view of the collapsible barrier in the retracted condition.

When the drilling operation is complete, the bellows 12 will normally be substantially collapsed, as shown in FIG. 11 (reference numeral 12"). The bellows 12 may then be released from the holder 18 to return with the drill head H to the home position. This release may be achieved manually, but preferably is done automatically by a projection 26 that causes the coupler 14 to separate from the holder 18 when the drill head H is at a particular position along the mast M (most preferably, the maximum position of advance). This projection 26 may be carried by the drill head H such that it pivots the arms 22 upwardly (note position 22' in FIG. 11) within the slots 24*a* and thereby separates the coupler 14 (projections 14*a*, 14*b*) and magnets 20 to break the coupling.

The drill head H may then be lowered with the bellows 12 in the retracted condition (12"), with the coupler 14 detached from the holder 18. Concurrently, the projection 26 withdraws to allow the arms 22 and hence magnets 40 to return to the home position relative to the retainer 24. As should be appreciated, in this retracted condition of the bellows 12, a portion of the drill steel S covered in the extended condition is exposed as the drill head H is returned to the home position (compare FIG. 2*a* with FIG. 2*b*). In this position, the drill steel S may then be disassociated with the drill head H (as shown in FIG. 7), if desired, and replaced with a roof bolt or a different drill steel (in which case the above-described procedure may be repeated). In the case of a roof bolt, the drill head H may then be advanced to install the roof bolt into the previously formed borehole (which may include pre-installed resin). The basic roof bolting process is described in U.S. Pat. No. 5,951,208 to Wilson et al., the disclosure of which is incorporated herein by reference.

A particular advantage of this arrangement is that bellows 12 at all times remains carried by the drill head H and provides coverage for a substantial portion of the drill steel S that would otherwise be exposed and cause a significant amount of noise during the formation of the borehole. Additionally, the operator is not required to handle the bellows 12 at anytime during the drilling cycle. Rather, once the formation of the borehole is complete, the drill head H may simply be retracted with the bellows 12 in the retracted condition. Thus, the operator only is required (at most) to handle the bellows 12 to move it to an extended condition prior to the drilling cycle, which is of course convenient and contributes to an enhanced efficiency. Consequently, there is also no need to remove and store the bellows 12.

Preferably, the bellows 12 comprises a durable, yet flexible (and most preferably, pleated) material, such as aluminum coated fiberglass. Stiffeners (such as springs) or support plates may also be incorporated into the bellows 12 to add rigidity, if necessary. The diameter of the bellows 12 should be sufficient to avoid any interference with the rotation of the drilling element or steel S, and bearings may be incorporated to facilitate the free relative rotation of these structures. The length of the bellows 12 will depend on the particular application, and need not correspond to the fully advanced position of the drill head H.

The foregoing descriptions of various embodiments of the invention are provided for purposes of illustration, and are not intended to be exhaustive or limiting. Modifications or variations are also possible in light of the above teachings. Of course, it should be appreciated that the height of the bellows 12 may be adjusted to suit the particular application. It should also be appreciated that other embodiments may be used for engaging the coupler 14 with the holder 18 (such as for example, latches, clips, electromagnets, frictional engagements, or the like). Also, it is possible to provide the magnets 20 on the coupler 14, rather than on the holder 18. The device 10 may also be used in embodiments that do not include a mast, such as an arm feed arrangement where the canopy or other drill guide serves as the holder 18 for coupling with the coupler 14. The embodiments described above were chosen to provide the best application to thereby enable one of ordinary skill in the art to utilize the disclosed inventions in various embodiments with various modifications as are suited to the particular use contemplated. All such modifications and variations are within the scope of the invention.

The invention claimed is:

1. An apparatus for use in abating noise arising from the operation of a drill head including a drilling element for engaging a face of a mine passage during a drilling cycle in which the drill head moves from a first position farther from the face to a second position closer to the face, comprising:

a collapsible barrier capable of moving between an extended condition covering a portion of the drilling element and a retracted condition in which the portion of the drilling element covered in the extended condition is exposed; and a holder adapted for releasably coupling with and holding the collapsible barrier in the extended condition and separating from the collapsible barrier in the retracted condition.

2. The apparatus of claim 1, wherein the holder comprises at least one magnet for forming a magnetic coupling with a coupler associated with an upper end of the barrier.

3. The apparatus of claim 2, wherein the holder comprises a plurality of magnets, and the coupler comprises first and second projections for coupling with the magnets of the holder.

4. The apparatus of claim 2, further including a projection for breaking the magnetic coupling when the barrier reaches the retracted condition so that the barrier in the retracted condition may travel with the drill head in moving from the second, advanced position to the first position.

5. The apparatus of claim 4, wherein the at least one magnet is carried by a movable arm, and the projection moves the arm to break the coupling.

6. The apparatus of claim 4, wherein the projection is carried by the drill head.

7. The apparatus of claim 1, wherein the drill head is supported by a mast, and the mast supports the holder.

8. The apparatus of claim 1, further including a cover for at least partially covering an upper end of the collapsible barrier, said cover including an opening for receiving the drilling element.

9. The apparatus of claim 1, wherein a lower end of the collapsible barrier is adapted for being removably connected to an upper face of the drill head by at least one fastener.

10. An apparatus for use abating noise from the operation of a drill head including a drilling element for engaging a face of a mine passage during a drilling cycle in which the drill head moves from a first position farther from the face to a second position closer to the face, comprising:

a collapsible barrier for at least partially covering the drilling element, said collapsible barrier being capable of assuming a retracted condition corresponding to the second position of the drill head and an extended condition corresponding to the first position of the drill head; and a holder for holding the collapsible barrier in the extended condition, wherein the collapsible barrier separates from the holder in the retracted condition.

11. The apparatus of claim 10, further including a coupler carried by the collapsible barrier for releasably coupling with the holder in the extended condition.

12. The apparatus of claim 11, wherein the holder comprises a first magnet for forming a magnetic coupling with the coupler.

13. The apparatus of claim 11, further including a projection for breaking the coupling at the end of the advance of the drill head so that the barrier in the retracted condition may travel with the drill head to a home position.

14. The apparatus of claim 13, wherein the projection is carried by the drill head.

15. A method of abating noise from the operation of a drill head including a drilling element for engaging a surface of a mine passage during a drilling cycle in which the drill head moves from a first position farther from the face to a second position closer to the face, comprising:

covering a portion of the drilling element with a collapsible barrier maintained in an extended condition corresponding to the first position of the drill head by a releasable coupling with a holder;

engaging the face with the drilling element; and withdrawing the drilling element from the face with the barrier in the retracted condition in which the portion of the drilling element covered in the extended condition is exposed.

16. The method of claim 15, wherein the covering step comprises coupling the collapsible barrier to the drill head at one end and to the holder at the opposite end.

17. The method of claim 16, wherein the coupling step comprises magnetically coupling a coupler carried by the collapsible barrier to the holder.

18. The method of claim 17, further including the step of breaking the magnetic coupling before the withdrawing step.

19. The method of claim 16, further including the step of supporting the holder from a drill mast along which the drill head travels to between the first and second positions.

20. The method of claim 15, further including the steps of removing the drilling element from the drill head after the withdrawing step and associating a roof bolt with the drill head.

* * * * *